US009912085B2

(12) United States Patent
Gehrke et al.

(10) Patent No.: US 9,912,085 B2
(45) Date of Patent: Mar. 6, 2018

(54) MODULE INTERFACE

(71) Applicant: Euchner GmbH & Co. KG, Leinfelden-Echterdingen (DE)

(72) Inventors: Mike Gehrke, Hochdorf (DE); Jörg Klaiber, Hildrizhausen (DE); Bernd Hermann, Rottenburg (DE)

(73) Assignee: Euchner GmbH & Co. KG, Leinfelden-Echterdingen (DE)

( * ) Notice: Subject to any disclaimer, the term of this patent is extended or adjusted under 35 U.S.C. 154(b) by 0 days.

(21) Appl. No.: 15/222,984

(22) Filed: Jul. 29, 2016

(65) Prior Publication Data

US 2017/0040723 A1 Feb. 9, 2017

(30) Foreign Application Priority Data

Aug. 6, 2015 (DE) ..... 20 2015 104 123 U

(51) Int. Cl.

| | |
|---|---|
| ***H01R 25/00*** | (2006.01) |
| ***H01R 27/02*** | (2006.01) |
| ***H01R 31/00*** | (2006.01) |
| ***H01R 33/00*** | (2006.01) |
| ***H01R 12/71*** | (2011.01) |
| ***H01R 29/00*** | (2006.01) |
| ***H01R 31/06*** | (2006.01) |
| ***H01R 12/75*** | (2011.01) |
| ***H01R 24/76*** | (2011.01) |
| *H01R 33/88* | (2006.01) |
| *H01R 33/94* | (2006.01) |
| *H01R 24/54* | (2011.01) |
| *H01R 107/00* | (2006.01) |

(52) U.S. Cl.

CPC ..... *H01R 12/716* (2013.01); *H01R 12/75* (2013.01); *H01R 24/76* (2013.01); *H01R 29/00* (2013.01); *H01R 31/06* (2013.01); *H01R 24/54* (2013.01); *H01R 33/88* (2013.01); *H01R 33/94* (2013.01); *H01R 2107/00* (2013.01)

(58) Field of Classification Search

CPC ..... H01R 24/54; H01R 25/00; H01R 31/06; H01R 33/88; H01R 33/94

USPC ..... 439/638, 639, 654, 928, 651

See application file for complete search history.

(56) References Cited

U.S. PATENT DOCUMENTS

| | | | | |
|---|---|---|---|---|
| 6,036,505 | A * | 3/2000 | Zell | H05K 1/145 439/74 |
| 9,300,081 | B2 * | 3/2016 | Rudisill | H01R 13/6205 |
| 2004/0235355 | A1 * | 11/2004 | Coniff | H01R 31/065 439/638 |
| 2005/0170699 | A1 * | 8/2005 | Overtoom | H01R 31/065 439/639 |
| 2015/0270645 | A1 * | 9/2015 | Sato | H01R 12/737 439/651 |
| 2017/0005447 | A1 * | 1/2017 | Kim | H01R 13/6616 |

* cited by examiner

*Primary Examiner* — Tho D Ta
*Assistant Examiner* — Thang Nguyen
(74) *Attorney, Agent, or Firm* — Michael Soderman

(57) ABSTRACT

The invention relates to a module interface with a device-side connector provided on an electronic module with a number of contact elements. They are designed to form a plug-type connection with several corresponding plug-type connectors with different numbers of contact elements.

15 Claims, 10 Drawing Sheets

Fig. 14
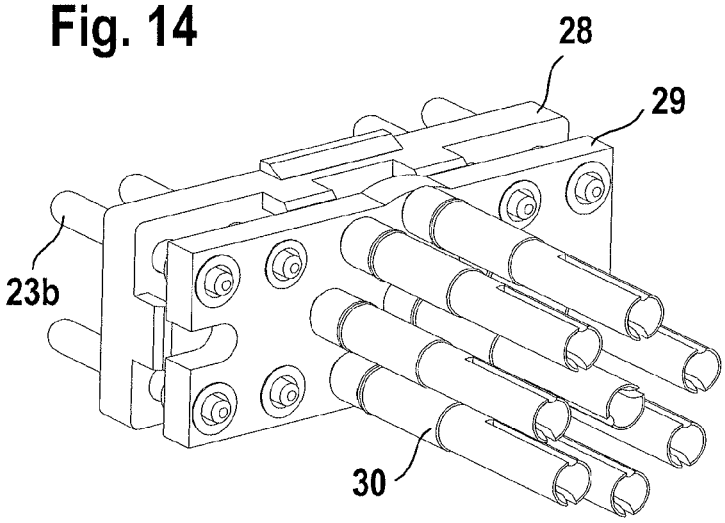
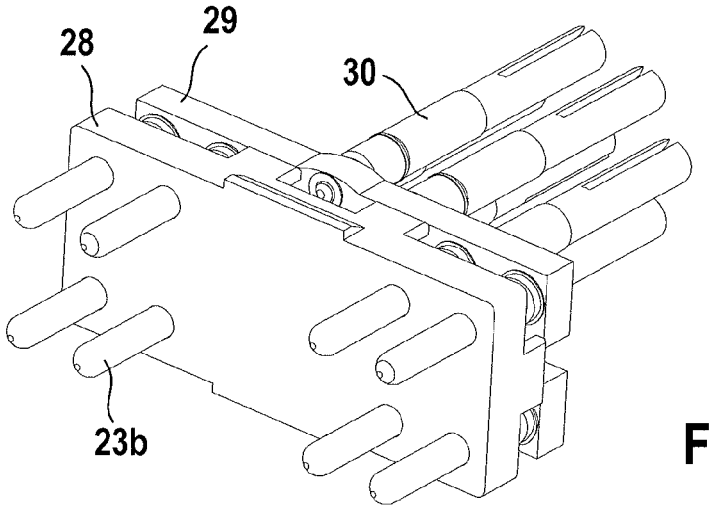
Fig. 15

MODULE INTERFACE

CROSS REFERENCE TO RELATED APPLICATIONS

This application claims the priority of DE 202015104123.3 filed on 2015 Aug. 6; this application is incorporated by reference herein in its entirety.

BACKGROUND

The invention relates to a module interface for an electronic module.

Electronic modules of the type under discussion can generally constitute devices for safety and automation technology; they can, in particular, be designed as safety switches.

Electronic modules of that kind can be aggregated into module arrangements; they will then form safety systems, for instance locking safety systems. One system of this type is the MGB safety system of the company Euchner, for example. This safety system ensures that movable, separating protective equipment is reliably kept closed, in particular protective doors, and that access is consequently secure to fenced-in, hazardous areas that are critical for safety.

This locking safety system is comprised of a locking module that is arranged on a handle module. These modules serve to reliably keep the protective door closed. The door handle of the handle module can be held in the closed position via spring force and unlocked via magnetic force. Alternatively, the door handle can be held in the closed position via magnetic force and unlocked via spring force.

The locking safety system has, moreover, a control module and a bus module in the form of functional modules that can be connected to the locking module. The control module has a control unit with several buttons and knobs. The bus module serves to connect the locking safety system to an external bus system.

The individual modules are connected via connection modules such as plugs and sockets; flat-ribbon cables that go into the individual modules run out of the connection modules.

A major drawback of safety systems of that kind is that their configuration cannot be changed or can only be changed to a limited extent, in particular because of the tightly predefined interfaces in the form of connection modules. An adaptation to different application or usage conditions is consequently only possible to a limited extent.

SUMMARY

The invention relates to a module interface with a device-side connector provided on an electronic module with a number of contact elements. They are designed to form a plug-type connection with several corresponding plug-type connectors with different numbers of contact elements.

DETAILED DESCRIPTION

The invention is based on the problem of providing a module interface for electronic modules that enables a high level of flexibility and variable usage possibilities for electronic modules of different forms.

The elements of claim 1 are specified to solve this problem. Advantageous embodiments and useful design developments of the invention are described in the dependent claims.

The invention relates to a module interface with a device-side plug-type connector provided on an electronic module with a number of contact elements that are designed to form a plug-in connection with several corresponding plug-type connectors with different numbers of contact elements.

The basic idea of the invention consequently consists in equipping the electronic module with a combination plug-type connector to the effect that corresponding plug-type connectors with different numbers of contact elements, and thus different connection patterns of contact elements, can be connected to this combination plug-type connector.

The module interface as per the invention is therefore not restricted to a certain type that is predetermined in terms of hardware. Instead, a choice of different plug-type connector models can be connected to the combination plug-type connector of the electronic module.

The usage possibilities of the electronic module are also expanded because of this variability of the module interface. In particular, the electronic module can be used in different module arrangements without hardware changes for this having to be made to the electronic module or to the module interface. Variable safety systems, for instance locking safety systems, can especially be realized with the module interface as per the invention.

In accordance with an important aspect of the invention, the functionality of the module interface and/or of the electronic module is changed via the connection of different corresponding plug-type connectors to the device-side plug-type connectors.

The functionality of the module interface and/or of the electronic module can therefore be adapted solely by the selection of a corresponding plug-type connector connected to the plug-type connector of the electronic module. This represents a particularly user-friendly adaptation possibility that can be quickly and easily carried out by the operating personnel.

In principle, the device-side combination plug-type connector can be designed in the form of a plug.

It is especially advantageous when the device-side plug-type connector is a socket. The corresponding plug-type connectors are designed as plugs.

In accordance with an advantageous embodiment of the invention, the contact elements of different corresponding plug-type connectors are put into contact with various contact elements of the device-side plug-type connector.

In that case, the combination plug-type connector has contact holes whose physical arrangement and quantity are chosen in such a way that contact can be made with the contact pins of different plugs as corresponding plug-type connectors there. An unambiguous assignment is already created on the hardware side to different corresponding plug-type connectors because of the physical separation of areas of the contact elements of the combination plug-type connector that is obtained.

An advantageous example of this is provided when the device-side plug-type connector is designed to connect a five-pin and an eight-pin corresponding plug-type connector. The device-side plug-type connector has five contact elements to connect the five-pin corresponding plug-type connector and a further eight contact elements to connect the eight-pin corresponding plug-type connector.

In this embodiment, the five-pin plug-type connector can constitute the connection means for a bus system, meaning that a serial transmission of bus data takes place via contact elements of this connector. The eight-pin plug-type connector, in contrast, constitutes parallel wiring the effect that a certain signal is transmitted in a targeted manner in each case via individual contact elements of the module interface that are connected to one another. Thus, the type of data transmission through the module interface is changed depending on whether a five-pin or eight-pin corresponding plug-type connector is connected to the combination plug-type connector.

In accordance with an advantageous design form of the invention, the device-side plug-type connector constitutes a connection module that can be connected to the electronic module.

The electronic module can constitute, in particular, a safety switch or in general a component of a safety system. As an example, the electronic module can be a component of a locking safety system.

The connection module can be advantageously brought into contact with a circuit board of the electronic module.

In principle, the connection module can be hard-wired to the electronic module in the process.

It is especially advantageous when the connection module constitutes a unit that can be exchanged in the electronic module.

This can be achieved with plug-in connection contacts such as spring contacts, as an example.

In accordance to a first variant, the corresponding plug-type connector or each corresponding plug-type connector constitutes a connection module that can be put into contact with an electronic module.

Different electronic modules can therefore be directly connected via the plug-type connectors of the module interface.

In accordance with a second variant, the plug-type connector or each plug-type connector is a component of a connection module for connecting a cable.

Electronic modules, especially of a safety system such as a locking safety system, can be connected via cable connections with connection modules of that type. In general, simpler accessory parts such as key switches, or operating status indicators such as so-called stack lights, for instance, can therefore also be integrated into module arrangements that work with the module interfaces as per the invention.

The connection module also has a cable connection in the form of a cable plug or a cable socket in this embodiment, in addition to the corresponding plug-type connector that can be connected to a combination plug-type connector of an electronic module.

In general, the number of contact elements of the cable plug or the cable socket of the cable connection corresponds to the number of contact elements of the corresponding plug-type connector.

In accordance with a first variant, the cable plug or the cable socket of the cable connection, on the one hand, and the corresponding plug-type connector, on the other hand, have the same connection patterns of contact elements. Each contact element of the cable plug or the cable socket of the cable connection is directly connected to a line of the contact element of the corresponding plug-type connector.

In accordance with a second variant, the cable plug or the cable socket of the cable connection have, on the one hand, contact patterns of contact elements. Conversion units are provided in the connection module via which the connection pattern of the cable plug or the cable socket of the cable connection is converted to the connection pattern of the corresponding plug-type connector.

The conversion units advantageously have a board.

An adaptation to a connection pattern of the corresponding plug-type connector, which can be directly connected to a combination plug-type connector, therefore takes place in the cable connection with very little constructional effort.

BRIEF DESCRIPTION OF THE DRAWINGS

The invention will be explained with the aid of the drawings below. The following are shown in the figures:

FIG. 14: Diagram of conversion units of the second cable connection module in a first view.

FIG. 15: Plan view of conversion units of the second cable connection module in a second view.

DETAILED DESCRIPTION OF THE PREFERRED EMBODIMENTS

Figure 1:
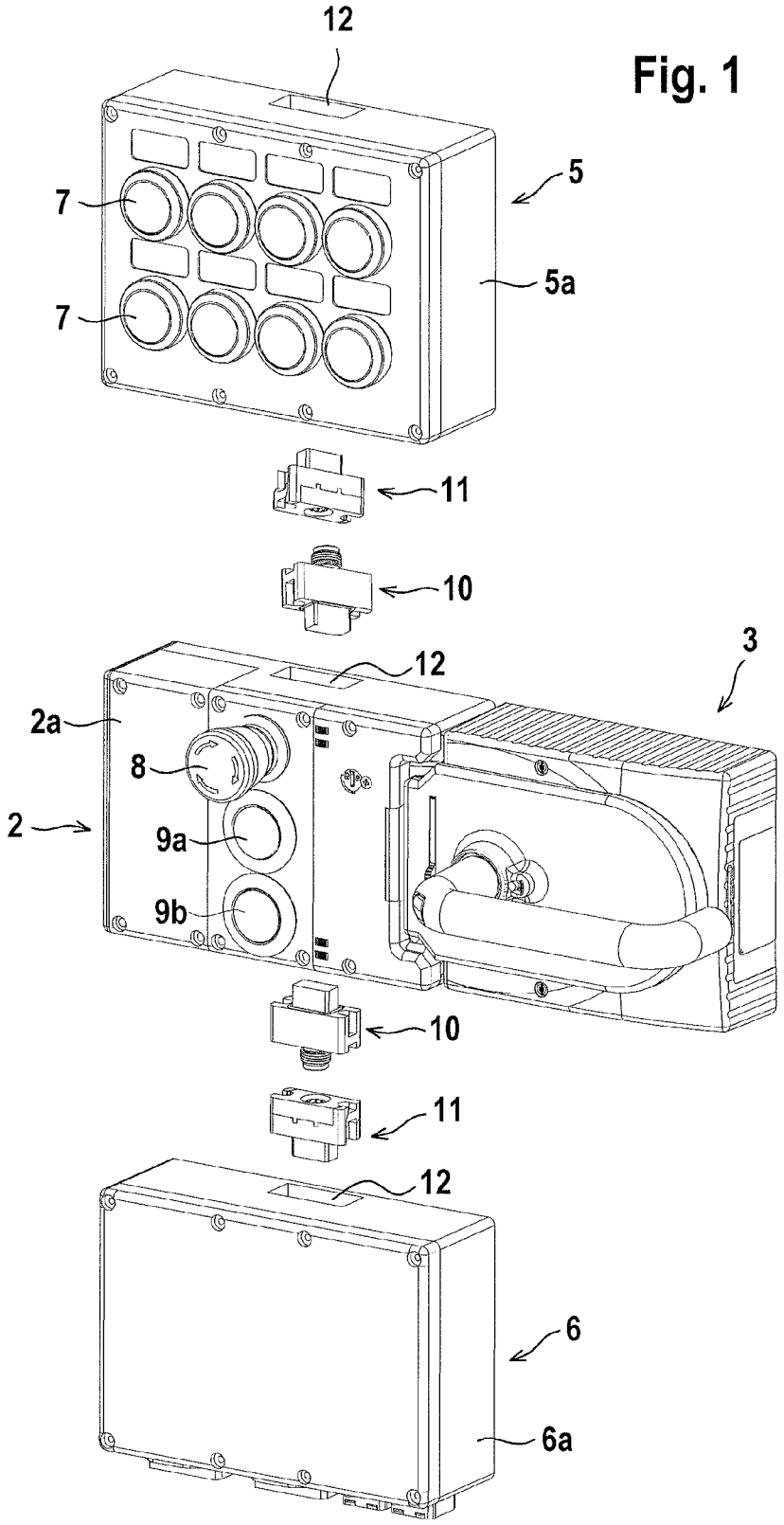
FIG. 1: First variant of an example of the module arrangement as per the invention.
Figure 2:
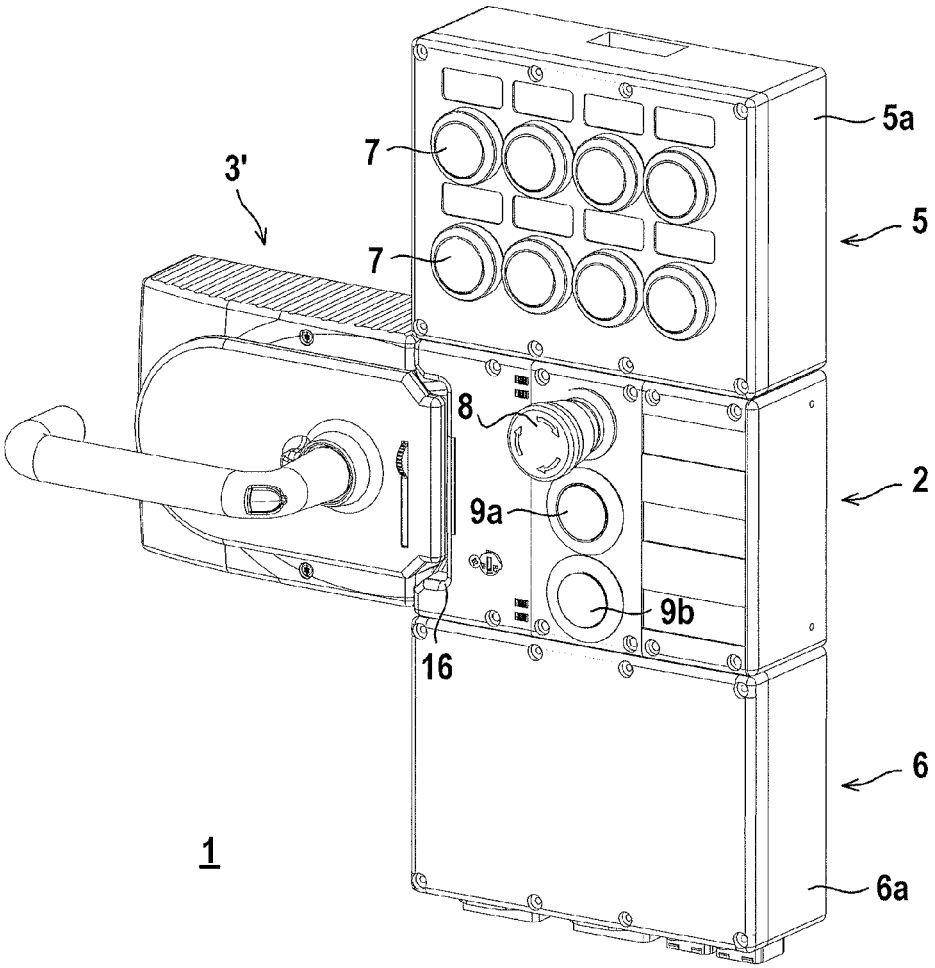
FIG. 2: Second variant of the module arrangement in accordance with FIG. 1.
Figure 3:
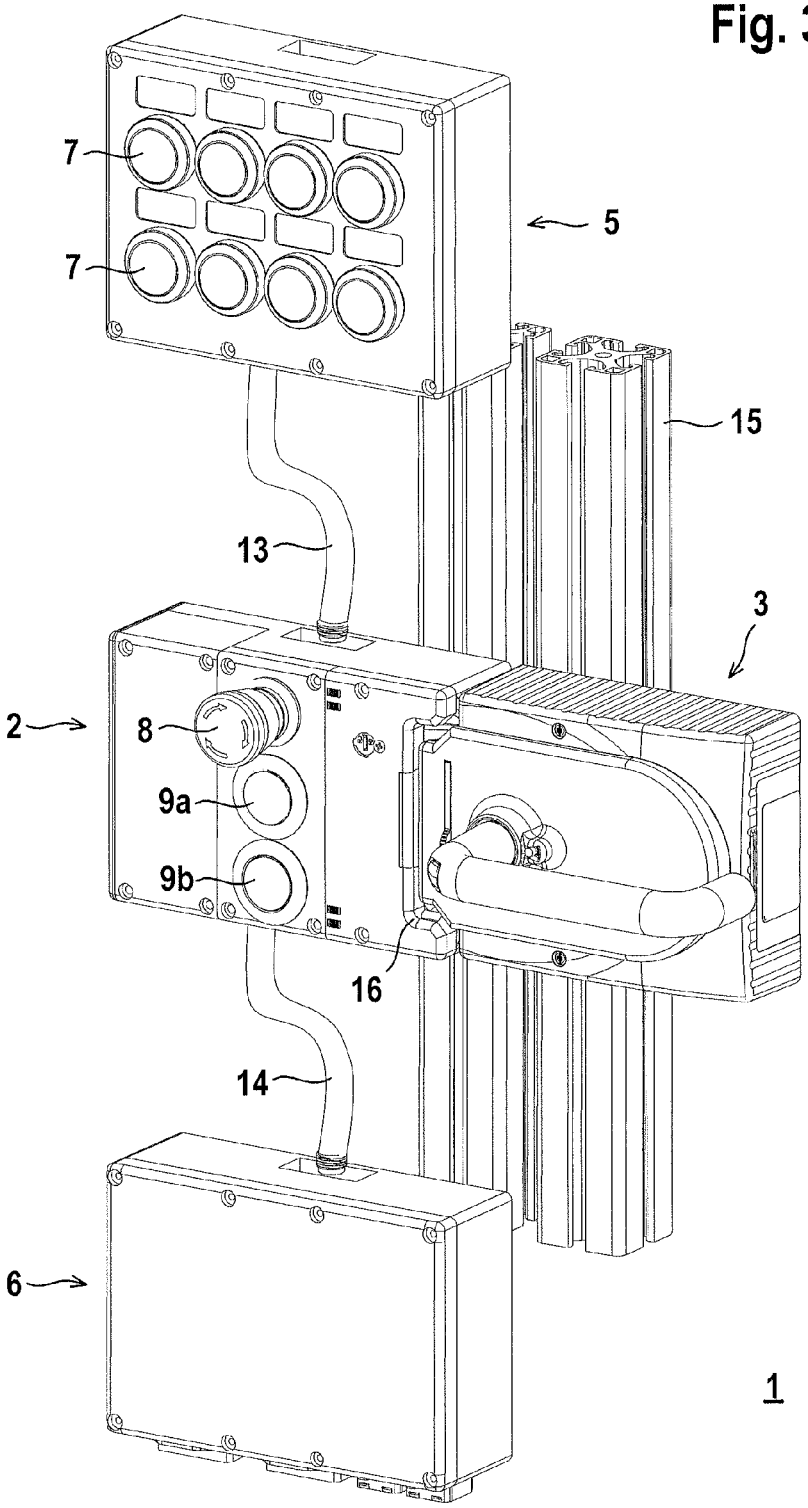
FIG. 3: Third variant of the module arrangement in accordance with FIG. 1.

FIGS. 1 and 3 show three variants of a module arrangement 1 as application examples for the module interface as per the invention. The module arrangement 1 constitutes in the instant case a safety system, specifically a locking safety system, that has a locking module 2 as a base module. In the arrangement of FIG. 1, a right-hand handle module 3 is arranged on the right-hand side of the locking module 2. In the arrangement of FIG. 2, a left-hand handle module 3' is arranged on the left-hand side of the same locking module 2. The handle module 3, 3' has a door handle 4 in both cases.

The locking module 2 and the handle module 3, 3' form a functional unit that ensures that a protective door or the like is kept closed. The door handle 4 can be held in the closed position with spring force in principle and unlocked via magnetic force. In the instant case, the door handle 4 is kept in the closed position via magnetic force that is generated via magnets arranged in the locking module 2 and unlocked via spring force.

The module arrangement 1 of FIGS. 1 to 3 has, moreover, a control module 5 as a first functional module and a bus module 6 as a second functional module. The control module 5 constitutes a control unit and has several buttons 7 as control elements. The locking module 2 itself has an emergency stop button 8 and other buttons 9*a*, 9*b* for operation of the safety system. The bus module 6 serves to connect to the safety system to an external bus system.

The module arrangement 1 of FIGS. 1 to 3 can, in general, also be expanded to the effect that it will have several locking modules 2 with handle modules 3, 3' or also more functional modules such as bus modules 6 or control modules 5.

The electrical connection between the base module and the functional module is brought about by the connection modules 10, 11.

A connection module 10, 11 of this type is used for assembly to the base module or a functional module in a recess 12 in its housing 2*a*, 5*a*, 6*a*. When the connection module 10, 11 is used, it makes electrical contact with a circuit board, which is not shown, in the base module or in the functional module. Bus lines of a data-bus system that forms an internal bus system of the safety system and that operates independently of external bus systems are laid in the circuit board. The data-bus system can, in particular, be designed in the form of a CAN bus. Each connection module 10, 11 has a contact interface to make contact with the circuit boards.

The connection modules 10, 11 form a modular system. The modules of the module arrangement 1 can be connected via the connection modules 10, 11 (FIGS. 1 and 2) in a direct fashion or through cables 13, 14 (FIG. 3).

It is advantageous when the modules of the safety system are fastened to a profile rail 15, which is shown in FIG. 3.

The locking module 2 has, as the base module of the module arrangement 1, two connection modules 10, 11 on opposite sides that are rotationally invariant in terms of their electrical connections with regard to a rotation of the locking module 2 by 180°. This means that the locking module 2 forms completely identical connection interfaces to the control module 5 and to the bus module 6 both in a first rotary position (shown in FIG. 1) and in a second rotary position rotated by 180° with regard to that (shown in FIG. 2), and it can therefore be connected in an identical manner in both rotary positions to the control module 5 and the bus module 6 without additional bus circuits. This means, in turn, that one and the same locking module 2 can be used to both connect the right-hand handle module 3 (FIG. 1) and to connect the left-hand handle module 3' (FIG. 2). In the first case (FIG. 1), a receptacle 16 of the locking module 2 opens on the right-hand side to accommodate the right-hand handle module 3. In the second case (FIG. 2), the receptacle 16 opens on the left-hand side to accommodate the left-hand handle module 3'.

Figure 4:
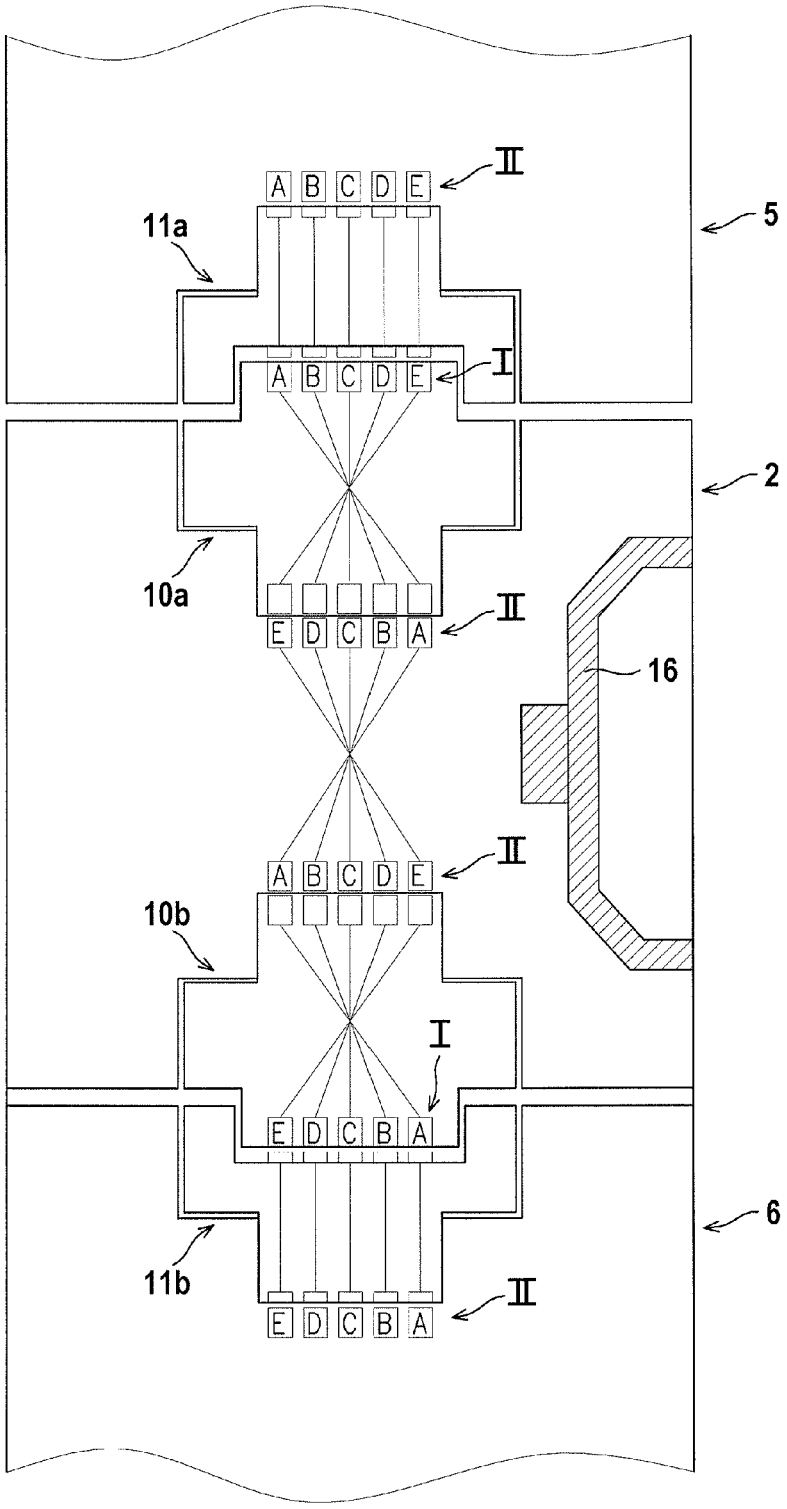
FIG. 4: Schematic diagram of the electrical connections of the individual connection modules of the module arrangement in accordance with FIG. 1.
Figure 5:
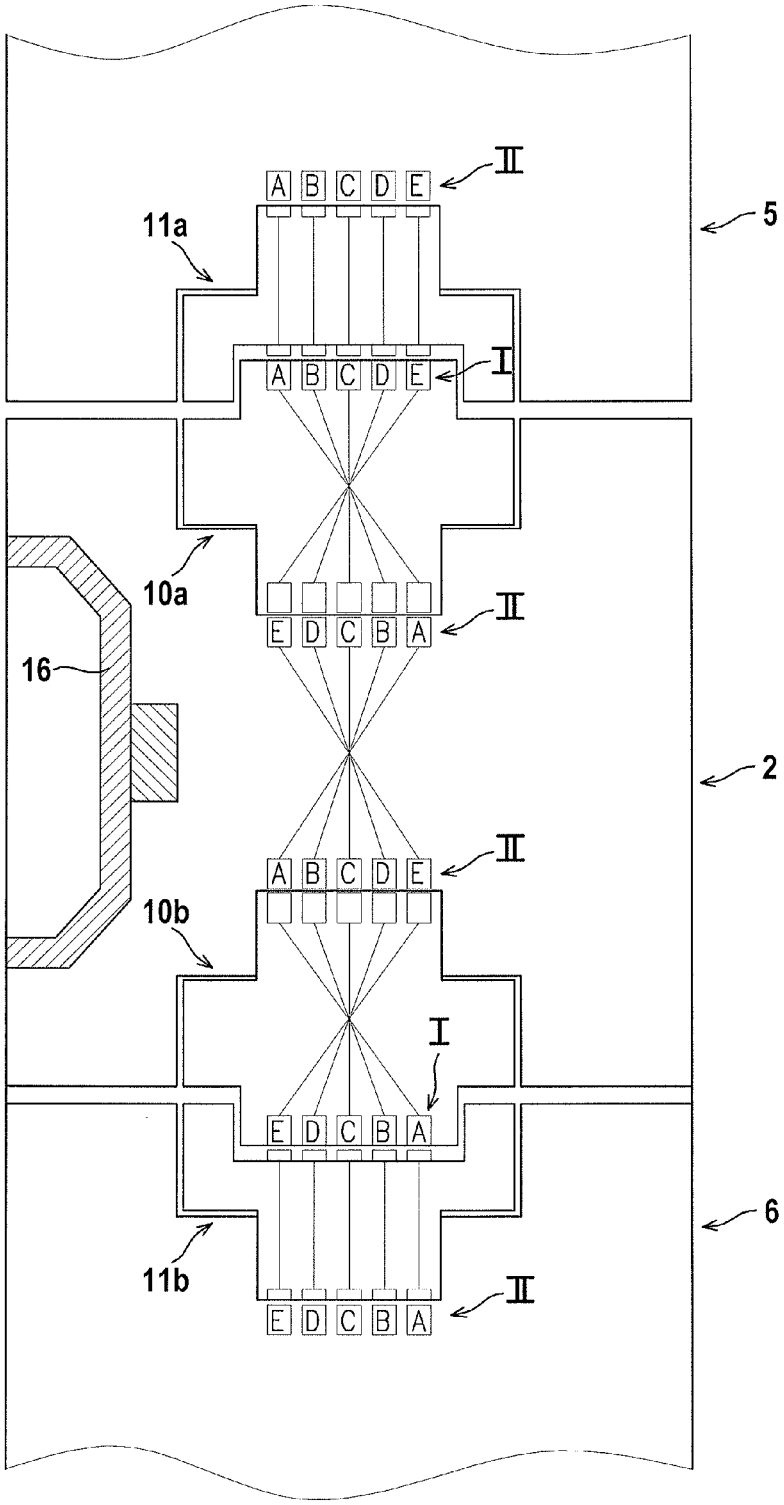
FIG. 5: Schematic diagram of the electrical connections of the individual connection modules of the module arrangement in accordance with FIG. 2.

The rotational invariance of the electrical connections of the connection modules 10, 11 of the locking module 2 is obtained with the connection arrangements shown in FIGS. 4 and 5.

FIGS. 4 and 5 schematically show the locking module 2 with two plug modules 10*a*, 10*b* as the connection module 10, 11, and the control module 5 and the bus module 6, each with a socket module 11*a*, 11*b*, as connection modules 10, 11. Alternatively, the locking module 2 can also be equipped with two sockets 11*a*, 11*b*. Plug modules 10*a*, 10*b* would then be provided in a corresponding fashion in the control module 5 and in the bus module 6.

Each socket module 11*a*, 11*b* and each plug module 10*a*, 10*b* of the arrangement of FIGS. 4 and 5 have external connection contacts A, B, C, D, E (designated as I in each case) that are assigned to the respective connection contact A, B, C, D, E of the allocated connection module 10, 11 on the opposite side. Furthermore, each socket module 11*a*, 11*b* and each plug module 10*a*, 10*b* of the arrangement of FIGS. 4 and 5 have internal connection contacts A, B, C, D, E (designated as II in each case) that are each connected to the inner circuit board 18 of the locking module 2, control module 5 or bus module 6 as the case may be.

With regard to the socket module 11*a*, 11*b* integrated into the control module 5 or the bus module 6, the internal connection contacts II and the external connection contacts I are connected via lines running in a straight line in each case, so the arrangement A, B, C, D, E of the internal connection contacts II corresponds to the arrangement A, B, C, D, E of the external connection contacts I.

With regard to the plug modules 10*a*, 10*b* in the locking module 2, however, the internal connection contacts II are connected via crossed lines with the external connection contacts I, so the sequence of internal connection contacts II (A, B, C, D, E) is reversed with regard to the sequence of external connection contacts (E, D, C, B, A). Furthermore, the internal connection contacts II of the plug modules 10*a*, 10*b* are connected via crossed lines; the sequence of the connection contacts II of the plug modules 10*b* (A, B, C, D, E) is reversed with regard to the sequence of the connection contacts I of the plug 10*a* (E, D, C, B, A).

Because of this wiring of the connection contacts I, II of the plug modules 10*a*, 10*b*, their connections are rotationally invariant in terms of a rotation of 180°, as a comparison of FIGS. 4 and 5 shows. With regard to the arrangement in accordance with FIG. 4, the locking module 2 is in a first rotary position in which the receptacle 16 for the connection of a right-hand handle module 3 is on the right-hand side. With regard to the arrangement in accordance with FIG. 5, the locking module 2 is in a second rotary position rotated by 180° with respect to the first rotary position in which the receptacle 16 for the connection of a left-hand handle module 3' is on the left-hand side. Completely identical connections of the plug modules 10*a*, 10*b* to the socket modules 11*a*, 11*b* of the control module 5 or the bus module 6 exist in both arrangements.

FIGS. 7 to 15 show embodiments of the module interfaces as per the invention or components thereof.

Figure 6:
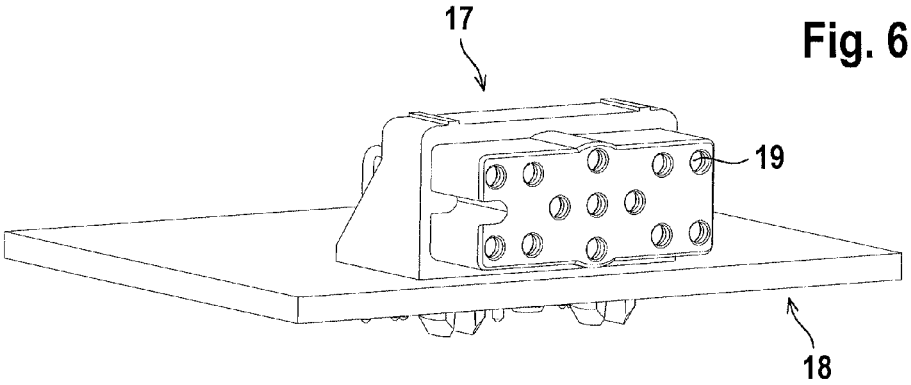
FIG. 6: Schematic diagram of a combination plug-type connector of the module interface as per the invention on a circuit board.
Figure 7:
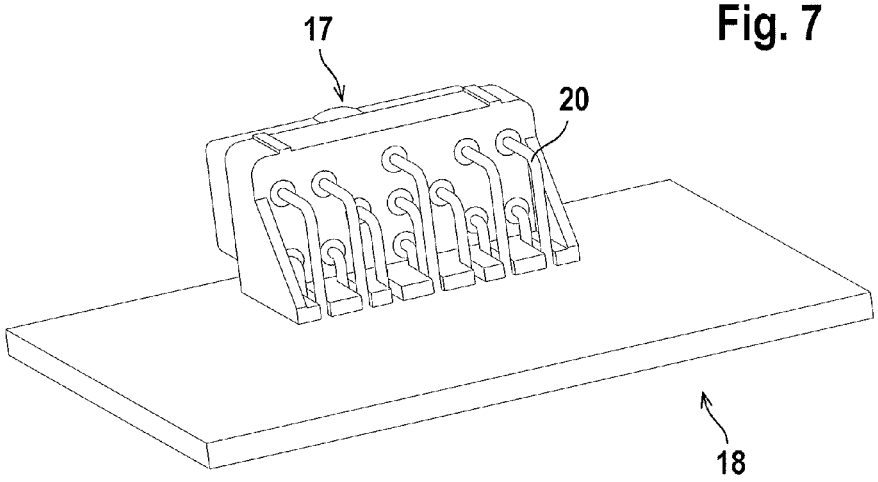
FIG. 7: Second view of the arrangement in accordance with FIG. 6.

FIGS. 6 and 7 show a combination plug-type connector 17, meaning a device-side plug-type connector as a component of the module interface as per the invention. The combination plug-type connector 17 forms a connection module 10, 11 that is integrated into an electronic module; an electronic module of that type can be a locking module 2, a control module 5 or a bus module 6, for instance, in accordance with the examples of FIGS. 1 to 5. The integration into the electronic module takes place, as FIGS. 6 and 7 show, via the connection of the combination plug-type connector 17 to a circuit board 18.

The front of the combination plug-type connector 17 has several contact elements in the form of contact holes 19. Lines 20 via which the combination plug-type connector 17 is connected to contacts of the circuit board 18 run out at the back of the combination plug-type connector 17. One line 20 is assigned in each case to one contact hole 19 of the combination plug-type connector 17 here. Since the front side with the contact holes 19 is arranged to be perpendicular to the plane of the circuit board 18, the lines 20 running out at the combination plug-type connector 17 are redirected by 90° before they are led to the circuit board 18.

The number of holes, meaning the number of contact holes 19 of the combination plug-type connector 17, and their arrangement, meaning the connection pattern of the contact holes 19, are designed in accordance with the invention in such a way that different corresponding plug-type connectors with various numbers of contacts and connection patterns can be connected to the contact holes 19 of the combination plug-type connector 17.

Figure 8:
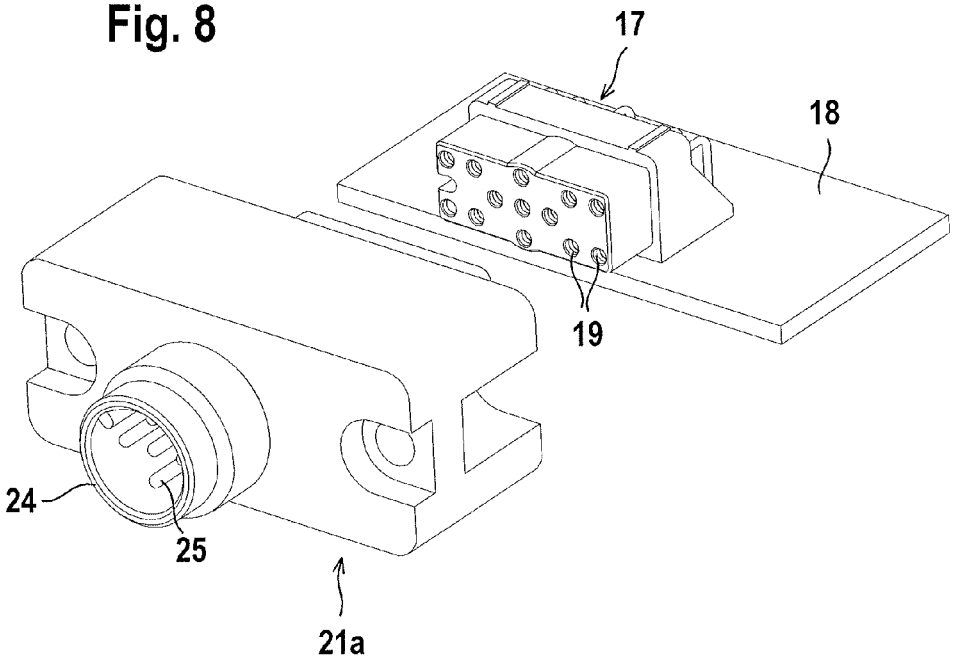
FIG. 8: Assignment of a first cable connection module to the combination plug-type connector of FIGS. 6 and 7 in a first view.

FIGS. 8 and 15 show various examples of device-side plug-type connectors of that type.

Figure 9:
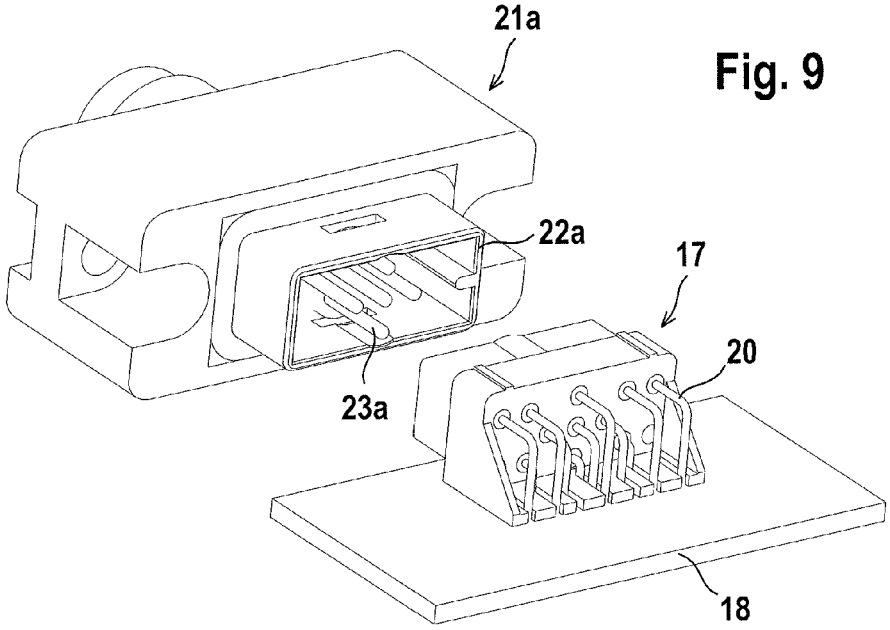
FIG. 9: Assignment of a first cable connection module to the combination plug-type connector of FIGS. 6 and 7 in a second view.
Figure 10:
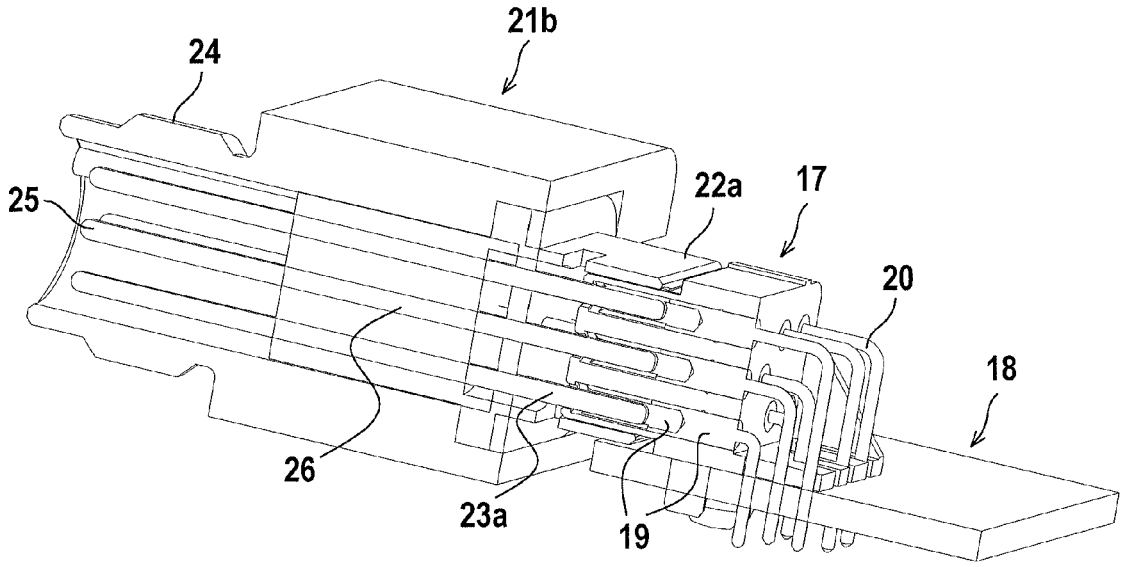
FIG. 10: Diagram of the cable connection module of FIGS. 8 and 9 connected to the combination plug-type connector.

FIGS. 8 and 9 show a first corresponding plug-type connector as a component of a first cable connection module 21*a*. The corresponding plug-type connector is designed in the form of a five-pin plug 22*a*, meaning that the plug 22*a* has five contact pins 23*a*. The five contact pins 23*a* of the plug 22*a* can be inserted into the five central contact holes 19 of the combination plug-type connector 17 by pushing the plug 22*a* into the combination plug-type connector 17; the module interface as per the invention is formed because of that. FIG. 10 shows the cable connection module 21*a* in contact with the combination plug-type connector 17 in that way.

The cable connection module 21*a* also has a cable connection for connecting a cable 14, in addition to the plug 22*a* for a connection to the combination plug-type connector 17. The cable connection is designed in the form of an M12 connection in this case. The cable connection is designed in the form of a combination plug-type connector 17 here. The combination plug-type connector 17 is designed, like the plug 22*a* of the cable connection module 21*a*, to have five contacts; the five contact pins 25 of the combination plug-type connector 17 have the same connection pattern, meaning the same arrangements as the contact pins 23*a* of the plug 22*a*. In this case, the contact pins 25 of the combination plug-type connector 17 are each directly connected via a line 26 to a contact pin 23*a* of the plug 22*a*.

Aside from the plug 22*a* of the cable connection module 21*a* of FIGS. 8 to 10, the plug 22*b* of the cable connection module 21*b* of FIGS. 11 to 15 can also be connected to the combination plug-type connector 17 of FIGS. 6 and 7. The plug 22*b* of the cable connection module 21*b* is designed with eight contacts, meaning it has eight contact pins 23*b*. The eight contact pins 23*b* are divided up into two groups of four that are arranged with mirror symmetry with respect to the central axis of the plug 22*b*. When the plug 22*b* is inserted into the combination plug-type connector 17, the eight contact pins 23*b* are accordingly inserted into the external contact hole 19 of the combination plug-type connector 17.

When plug 22*b* is put into contact with the combination plug-type connector 17, on the one hand, and plug 22*a* is put into contact with the combination plug-type connector 17, attached complementary contact holes 19 of the combination plug-type connector 17 are thereby used, meaning that each contact hole 19 of the combination plug-type connector 17 is only used by one plug 22*a* or 22*b*. A hardware-based, unique assignment of the contact holes 19 of the combination plug-type connector 17 to the contact pins 23*b* of only one of the plugs 22*a, b* therefore results.

Accordingly, the number of contact elements of the combination plug-type connector 17 corresponds to the sum of the contact elements of the different plug variants to be connected. Since eight-contact and five-contact plug variants can therefore be connected to the combination plug-type connector 17, it has thirteen contact elements.

Figure 11:
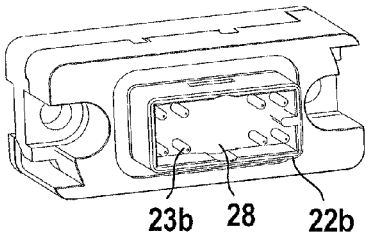
FIG. 11: Plan view of the front side of a second cable connection module.
Figure 12:
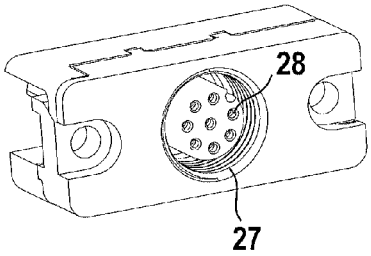
FIG. 12: Plan view of the rear side of the second cable connection module.

The cable connection module 21*b* has, in addition to the plug 22*b*, a cable connection that is designed in the present case as a cable socket 27. It forms a standard M12 connection for a cable 14. This cable socket 27 has eight contact holes 19. The cable socket 27 therefore constitutes, just like the plug 22*b* of the cable connection module 21*b*, an eight-contact connection element 30. But the connection patterns of the cable socket 27 and the plug 22*b*, meaning the geometric arrangements of their contact elements, are different as a comparison of FIGS. 11 and 12 shows.

Figure 13:
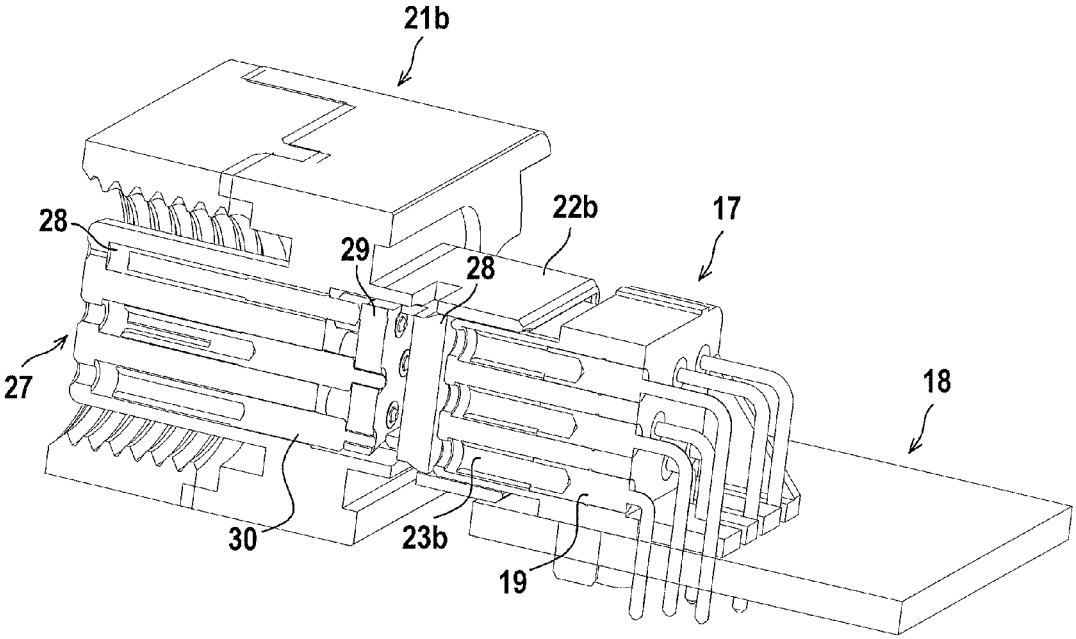
FIG. 13: Diagram of the second cable connection module connected to the combination plug-type connector.

Conversion units in the form of a board 29 supported on a holder 28 are provided for the conversion of the connection patterns. These elements are arranged in the interior of the cable connection module 21*b*, as FIG. 13 shows. The contact pins 23*b* of the plug 22*b* are supported on the holder 28 and led to the board 29, as FIGS. 14 and 15 show. The connection elements 30 for forming the contact holes 19 of the cable socket 27 are directly arranged on the board 29. Because of this conversion, the cable connection module 21*b* with the plug 22*b* can be directly inserted into the combination plug-type connector 17, on the one hand, since the connection pattern of the contact pins 23*b* of the plug 22*b* fits the connection pattern of the contact hole 19 of the combination plug-type connector 17. On the other hand, a cable 14 can be directly plugged into the cable socket 27 because the two connection patterns also fit one another here.

LIST OF REFERENCE NUMERALS (1) Module arrangement
(2) Locking module
(2*a*) Housing
(3) Right-hand handle module
(3') Left-hand handle module
(4) Door handle
(5) Control module
(5*a*) Housing
(6) Bus module
(6*a*) Housing
(7) Buttons
(8) Emergency stop button
(9 *a, b*) Buttons
(10) Connection module
(10 *a, b*) Plug module
(11) Connection module
(11 *a, b*) Socket module
(12) Recess
(13) Cable
(14) Cable
(15) Profile rail
(16) Receptacle
(17) Combination plug-type connector
(18) Circuit board
(19) Contact hole
(20) Line
(21*a*) Cable connection module
(21*b*) Cable connection module
(22*a*) Plug
(22*b*) Plug
(23*a*) Contact pin
(23*b*) Contact pin
(24) Cable plug
(25) Contact pin
(26) Line
(27) Cable socket
(28) Holder
(29) Board
(30) Connection element

The invention claimed is:

1. A module interface comprised of a sole device-side plug-type connector provided on an electronic module with a number of contact elements that are designed to form a plug-type connection with each of several corresponding plug-type connectors with differing numbers of contact elements, wherein a subset of contact elements of the sole device-side plug-type connector is used to connect each of the various corresponding plug-type connectors, and wherein the electronic module constitutes a component part of a safety system.

2. The module interface according to claim 1, characterized in that the functionality of the module interface and/or of the electronic module is changed by connecting a different, second set of corresponding plug-type connectors to the sole device-side plug-type connector.

3. The module interface according to claim 1, characterized in that the sole device-side plug-type connector is a socket and that the corresponding plug-type connectors are designed as plugs (22*a*, 22*b*).

4. The module interface according to claim 1, characterized in that the contact elements of each of the various corresponding plug-type connectors are put into contact with various contact elements of the sole device-side plug-type connector.

5. The module interface according to claim 4, characterized in that the sole device-side plug-type connector is designed to connect a five-contact corresponding plug-type connector and an eight-contact corresponding plug-type connector and that the sole device-side plug-type connector has five contact elements to connect the five-contact corresponding plug-type connector and a further eight contact elements to connect the eight-contact corresponding plug-type connector.

6. The module interface according to claim 1, characterized in that the sole device-side plug-type connector constitutes a connection module (10, 11) that can be connected to the electronic module.

7. The module interface according to claim 6, characterized in that the connection module (10, 11) can be put into contact with a circuit board (18) of the electronic module.

8. The module interface according to claim 6, characterized in that the connection module (10, 11) is a unit that can be exchanged on the electronic module.

9. The module interface according to claim 1, characterized in that the corresponding plug-type connector or each corresponding plug-type connector constitutes a connection module (10, 11) that can be put into contact with an electronic module.

10. The module interface according to claim 1, characterized in that the plug-type connector or each plug-type connector is a component of a connection module (10, 11) for connecting a cable (14).

11. The module interface according to claim 10, characterized in that the connection module (10, 11) has a cable connection in the form of a cable plug (24) or a cable socket (27).

12. The module interface according to claim 10, characterized in that the number of contact elements of the cable plug (24) or of the cable socket (27) of the cable connection corresponds to the number of contact elements of the corresponding plug-type connector.

13. The module interface according to claim 12, characterized in that the cable plug (24) or the cable socket (27) of the cable connection, on the one hand, and of the corresponding plug-type connectors, on the other hand, have the same connection patterns of contact elements and that each contact element of the cable plug (24) or the cable socket (27) of the cable connection is directly connected to a line (20) of a contact element of the corresponding plug-type connector.

14. The module interface according to claim 12, characterized in that the cable plug (24) or the cable socket (27) of the cable connection, on the one hand, and the corresponding plug-type connector, on the other hand, have differing connection patterns of contact elements and that conversion units are provided in the connection module (10, 11) via which the connection pattern of the cable plug (24) or the cable socket (27) of the cable connection is converted to the connection pattern of the corresponding plug-type connector.

15. The module interface according to claim 14, characterized in that the conversion units have a board (29).

* * * * *